US005992272A

United States Patent [19]

Fortner

[11] Patent Number: 5,992,272

[45] Date of Patent: Nov. 30, 1999

[54] KNOCK-OUT SOCKET

[76] Inventor: Douglas K. Fortner, 176 Brookwood Dr., Lowell, Ind. 46356

[21] Appl. No.: 08/968,318

[22] Filed: Nov. 12, 1997

[51] Int. Cl.[6] ..... B25B 13/02

[52] U.S. Cl. ..... 81/124.1; 81/121.1; 81/124.3; 81/124.6; 81/121.7

[58] Field of Search ..... 81/121.1, 124.3, 81/124.6, 121.7

[56] References Cited

U.S. PATENT DOCUMENTS

| | | | |
|---|---|---|---|
| 880,529 | 3/1908 | Heynau . | |
| 1,273,546 | 7/1918 | Sharp | 81/124.1 |
| 1,584,138 | 5/1926 | Pomije . | |
| 1,630,848 | 5/1927 | Ivey . | |
| 1,677,473 | 7/1928 | Gast . | |
| 2,067,370 | 1/1937 | Woock . | |
| 2,493,398 | 1/1950 | Fricke . | |
| 2,543,444 | 2/1951 | Dezorze . | |
| 2,651,229 | 9/1953 | Lenz . | |
| 2,660,081 | 11/1953 | Dossie . | |
| 2,669,148 | 2/1954 | Falk . | |
| 4,106,371 | 8/1978 | Akiyoshi . | |
| 4,535,657 | 8/1985 | Farris . | |
| 5,396,819 | 3/1995 | Bradley . | |
| 5,437,211 | 8/1995 | Wolfe . | |
| 5,590,574 | 1/1997 | Lide . | |
| 5,640,889 | 6/1997 | Anderson | 81/125 |

*Primary Examiner*—David A. Scherbel
*Assistant Examiner*—Shantese McDonald
*Attorney, Agent, or Firm*—John G. Premo

[57] ABSTRACT

A wrench socket having a jammed lug nut freeing spring actuated plunger for use with high torque impact wrenches to remove and replace wheel lug nuts from race cars. It consists of a hollow cylinder having an oversized lug nut engaging front end. The interior bore of the hollow cylinder contains longitudinal splines having slots which mate with corresponding projection on splines located on a capped plunger which allows the plunger to move vertically within the hollow cylinder. There is a horizontal removable pin located near the top of the hollow cylinder and extending through to its outer wall. The plunger contains a vertical slot near its top engaging the removable pin. This allows the plunger to extend into the lug nut engaging front end of the hollow cylinder from a retracted position. A compression spring is positioned on back end of the hollow cylinder and the bottom of the plunger's cap.

12 Claims, 2 Drawing Sheets

KNOCK-OUT SOCKET

FIELD OF THE INVENTION

This invention relates to wrench sockets used to remove and attach automotive lug nuts.

BACKGROUND OF THE INVENTION

During the course of an automobile race, it is often necessary for the participating race cars to make pit stops to change tires. The reasons may be varied, e.g., track conditions, tire wear, wheel problems, or the like. Time spent in the pits is critical to the outcome of a race. In the case of NASCAR races, current rules allow only two impact wrenches fitted with sockets adapted to remove and replace wheel lug nuts to be present over the safety wall of the track. This means little margin for error is present if the tires of a race car are to be changed in a minimum period of time.

The most common problem that slows down the changing of race car tires is that the lug nuts tend to jam in the wrench sockets. One reason for this jamming is that the socket opening is slightly oversized to allow quick engagement of the lug nut with the socket. When jamming occurs, it is often necessary for the pit crew member to stop and insert a screw driver blade into the socket to free the jammed lug nut.

Jam releasing wrench sockets have been suggested by the prior art. They are subject to several deficiencies that render them not suitable for removing jammed lug nuts from wrench sockets which are used to change tires of race cars. The primary approach shown by the prior art to free jammed lug nuts from wrench sockets is to use a retractable plunger that fits inside the socket and by the exertion of a downward thrusting force disengages the jam. These prior art devices, while perhaps working in light duty situations, are not capable of affording a socket which could function with any degree of certainty in the environment of changing the lug nuts of race cars during pit stops.

A plunger fitted wrench socket to be capable of use in the changing of race car tires during pit stops must contain a slightly oversized lug nut engaging opening to allow the socket to quickly engage the lug nuts of race cars. Most importantly, the plunger must engage the socket in a snug, non-slipping, unitary relationship so as to minimize wear on the socket and the plunger. This non-slipping relationship between the two parts, which affords rotational stability, must also be sufficiently strong so as to allow the socket and plunger to withstand the tremendous forces generated by pneumatic impact wrenches. The wrenches used to change racing car wheels have torques of about 500 lbs./sq. in. Also, the plunger must be capable of releasing a jammed lug nut from the socket quickly and without the use of wasted hand or arm motion. Due to design characteristics of earlier described wrenches, they are not capable of meeting these standards. Finally, most earlier described plunger fitted jammed lug nut extracting wrench sockets are incapable of disassembly for maintenance and part replacement. If it were possible to provide a plunger fitted wrench socket capable of meeting the above criteria, an advance in the art would be afforded.

OBJECTS OF THE INVENTION

It is an object of the invention to provide a plunger fitted wrench socket especially adapted for use with the lug nuts of race cars.

Another object is the provision of a plunger wrench fitted wrench socket which is substantially free of rotational play between the plunger and the socket.

A further object is a plunger fitted wrench socket which allows for the simple removal of jammed lug nuts therefrom.

Still another object is the furnishing of a plunger fitted wrench socket which is capable of withstanding the effects of high torques.

Yet another object is the provision of a plunger fitted wrench socket which may be easily disassembled for maintenance and repair.

Still another important object is the provision of a one piece wrench socket having the capability of quickly engaging and releasing hexagonal nuts from both conventional socket wrench drivers and high torque impact wrenches.

Other objects will appear hereafter.

SUMMARY OF THE INVENTION

The invention comprises a wrench socket having a jammed lug nut freeing plunger for use with high torque impact wrenches to remove and replace wheel lug nuts from race cars. Its first component is a hollow cylinder having an oversized lug nut engaging front end, as well as a back end with a shoulder. In an important embodiment of the invention, the interior of the lug nut engaging shaped opening contains a plurality of spaced apart triangular studs, which in most instances will be equidistant and six in number. Its interior or bore contains longitudinal splines having slots extending at least one half the length of the bore. The outer wall of the hollow cylinder contains opposed openings which receive a horizontally positioned removable pin located near the top of the hollow cylinder and extending through to the outer wall.

The second component of the wrench socket is a cylindrical rod shaped plunger substantially as long as the bore of the hollow cylinder. It has a front end and a back end fitted with a cap whose top contains a drive hole. The cap also has a bottom and sides and it is of larger dimension than the interior bore of the hollow cylinder. The cylindrical rod shaped plunger has an exterior side wall having longitudinal splines. The projections of these splines mate in sliding relationship with the slots of the splines within the hollow cylinder. The splines on the plunger preferably are longer and can protrude through the hollow cylinder. The rod shaped plunger contains a vertical slot which extends horizontally throughout the circumference of the rod shaped plunger. It is located near the top of the plunger and engages the removable pin. This allows the plunger to extend into the lug nut engaging front end of the hollow cylinder from a retracted position. The rod shaped plunger is maintained in the retracted position by means of a compression spring which has its front end supported on the shoulder of the hollow cylinder and its other or back end which engages the bottom of the plunger's cap.

The wrench socket has other more specific embodiments which include the feature of the bottom of the cylindrical rod shaped plunger being recessed. This compensates for long threaded wheel studs. To insure complete jammed lug nut extraction, it is important that the plunger is capable of extending at least part way and preferably completely into the lug nut shaped end of the hollow cylinder, which in a preferred embodiment of the invention is hexagonal. The outer wall of the hollow cylinder is desirably stepped decreasingly from its front end to its back end. Since the high impact wrenches used in the removal and replacement of race car tires have torques in the range of about 500 lbs./sq. in., it is beneficial that the splines in the bore of the hollow cylinder and on the outside wall of the plunger extend substantially the lengths thereof. It is evident that the splines in the bore of the hollow cylinder would not extend into the lug nut engaging opening portion of this assembly.

An important feature is that the interior has an oversized nut engaging front end of the socket which is hexagonal in configuration. The points are spaced apart and are beveled. Adjacent points have opposed angles which are interior angles. The spaces between the points are adjusted to provide a rotational arc of between 35 to 45 degrees. The arc is preferably 42 degrees. This should be compared to conventional hexagonal sockets which have rotational arcs between 1–2 degrees.

This particular configuration allows the hexagonal nuts to be readily engaged by the socket. When the high torque impact wrenches are used, it is sometimes possible to engage the nuts when the socket is rotating at a slow speed. Also, it is possible to release the nuts from the socket when the wrench is rotating at a relatively slow speed. This configuration, therefore, when used in conjunction with the plunger nut ejecting feature of the invention provides a superior system for preventing and freeing jammed nuts. In many cases, the nuts, if jammed, may be ejected by a slight amount of force of the type not requiring the use of the plunger ejector.

An important feature of the invention resides in and the use of the above-described hexagonally configured nut engaging front end in the design of a conventional wrench socket. By incorporating the large rotational angle into a conventional socket, the ability of such sockets to quickly engage and release from nuts is remarkably improved.

DRAWINGS

In the drawings, like parts have like numbers.

DETAILED DESCRIPTION OF THE INVENTION

Figure 1:
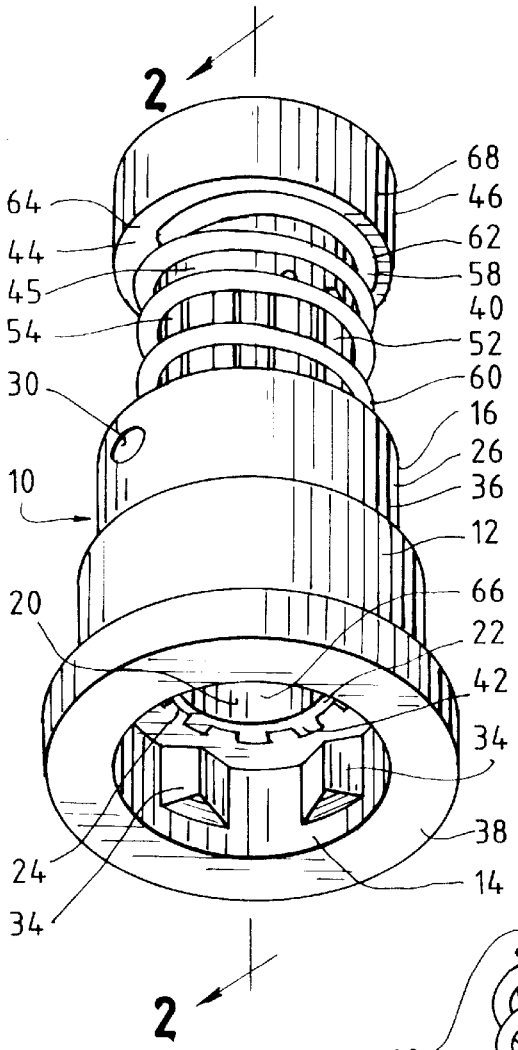
FIG. 1 is a perspective vertical view of the wrench socket of the invention.
Figure 3:
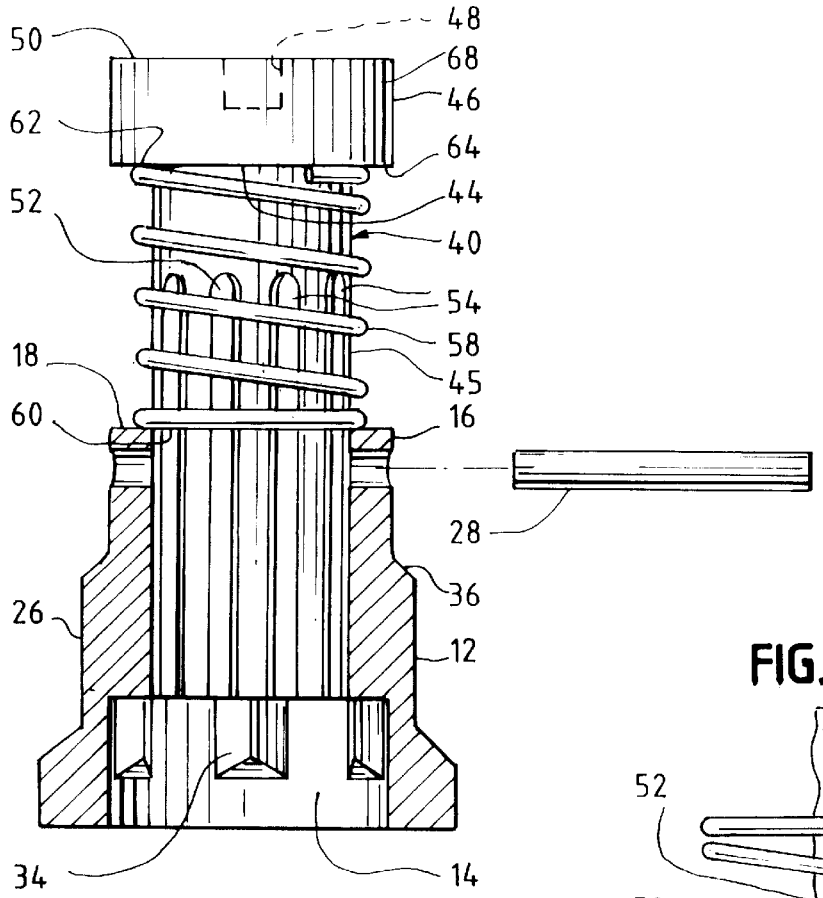
FIG. 3 is a vertical cutaway view showing the detail of the plunger.
Figure 4:
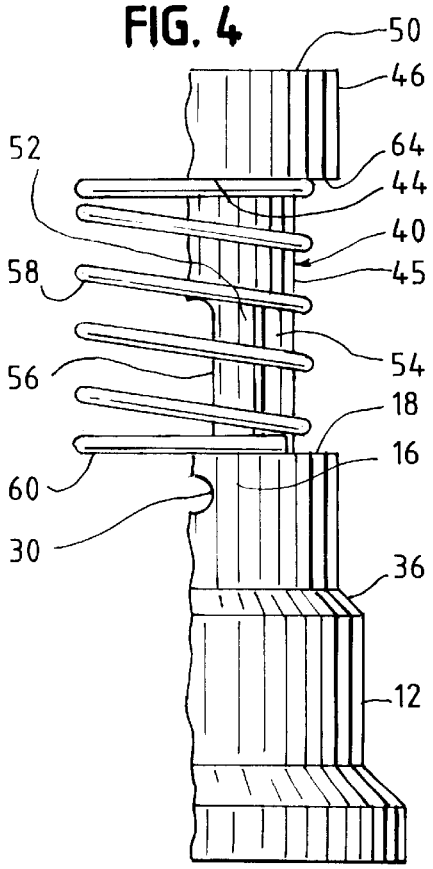
FIG. 4 is a partial vertical view showing the detail of the socket fitted with the plunger pin and spring.

With respect to the drawings, there is shown in FIG. 1 a wrench socket which is designated generally by the number 10. It is comprised of a hollow cylinder 12, a lug nut engaging front end 14, a back end 16 containing a shoulder 18 which is shown to best advantage in FIG. 3. It also has an interior bore 20 containing a flat surface 22 and slots 24. It is to be noted that the slots 24 are positioned around the entire inner circumference of the hollow cylinder 12. The outer wall of the hollow cylinder 26, near its top portion, is fitted with a pin 28. The pin 28 snugly engages opposed openings 30 and 32 which are located near the back end 16 of the hollow cylinder 12.

The lug nut engaging end 14 is hexagonally shaped. This configuration may be in the form of a conventional hexagon, but preferably the shape is achieved by means of a plurality of uniformly spaced apart triangular shaped inserts, which feature is shown by the number 34. In another preferred embodiment, the triangular shaped inserts are equilateral triangular points and are preferably six in number. As indicated earlier, this hexagonal lug nut engaging front end 14 is of slightly larger dimension than the race car lug nuts it is designed to engage. When the hexagonal opening comprises the triangular shaped inserts 34, the lug nut engaging front end 14 desirably contains a wide diameter collar 38. This arrangement allows the wrench to more quickly and securely engage and disengage the lug nuts of the race car. In a preferred embodiment, the hollow cylinder has its exterior 36 in the form of a stepped construction which adds to the strength of the hollow cylinder 12 and renders it admirably suitable to the heavy duty use of race car tire changing.

Fitted within the hollow cylinder 12 is a plunger designated generally by the number 40. This plunger 40 is substantially as long as interior bore 20 of the hollow cylinder 12. The plunger 40 has a front end 42, a back end 44, and sides 45, and is fitted with a cap 46. The cap 46 contains a drive hole 48 positioned in the top of the cap 50. The back end 44 of plunger 40 contains longitudinal splines 52. The projections 54 of longitudinal splines 52 are sized to slidingly yet snugly engage slots 24 located within interior bore 20 of the hollow cylinder 12. This use of mating splines is an important feature of the invention since it locks the hollow cylinder 12 and plunger 40 in a manner that prevents unwanted movement and rotational slippage.

Figure 2:
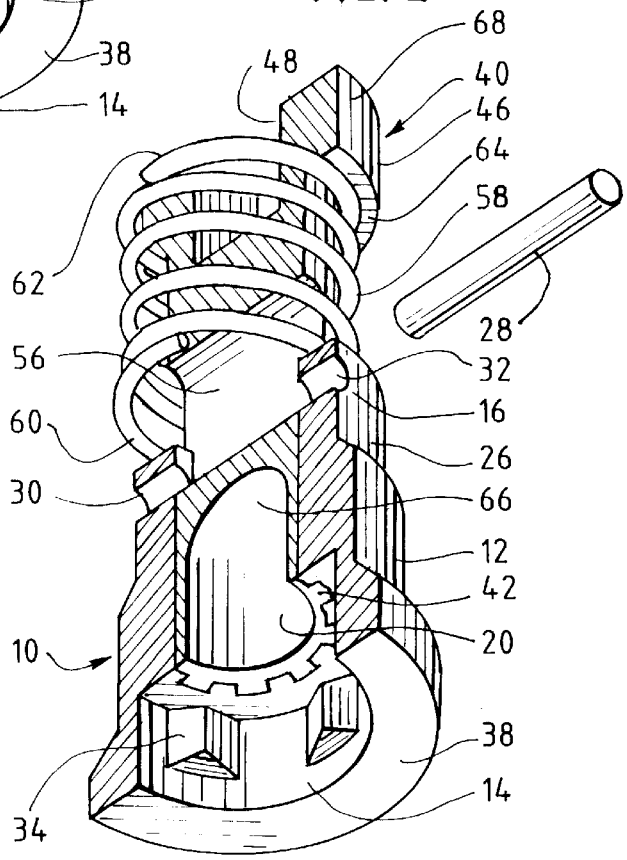
FIG. 2 is a vertical view across the line 2—2 of FIG. 1.

Located near the top of plunger 40 is a horizontally positioned slot 56. The horizontally positioned slot 56 extends through the entire diameter of the plunger 40. This feature is shown to best advantage in FIG. 2. The vertical length of the slot 56 determines the extent of upward and downward movement of the plunger 40 within the hollow cylinder 12. To couple the plunger 40 and the hollow cylinder 12 into a single unit is pin 28 which acts as a stop for the hollow cylinder 12. To maintain the plunger 40 in a recessed position, use is made of helical compression spring 58. The bottom 60 of compression spring 58 rests on top of shoulder 18 of the hollow cylinder 12. The top 62 of compression spring 58 engages the bottom 64 of plunger 40.

In a desirable embodiment of the invention, the front end 42 of plunger 40 is recessed. This feature is shown by the number 66 which is shown to best advantage in FIG. 2. This recessing allows for any protrusion of threaded studs (not shown) to which are fitted race car wheel lug nuts. Another desirable yet optional feature is the provision of vertical scoring designated generally by the number 68 on the side of the cap 46 of plunger 40. This allows a better grip to be had on the socket when it is inserted and removed from an impact wrench. Scoring 68 also imparts a more pleasing visual appearance to the wrench socket 10.

To assemble the components, front end 42 of plunger 40 is inserted sequentially into spring 58 and then into the interior bore 20 from the back end 16 of hollow cylinder 12. These parts are compressed using, for instance, a vise, with the opposed openings 30 and 32 being aligned with the horizontally positioned slot 56. Pin 28 is force fitted into openings 30 and 32, which allows it to pass through the horizontally positioned slot 56. This arrangement allows the wrench socket to be dismantled easily for purposes of repair and lubrication, if such is required.

Figure 5:
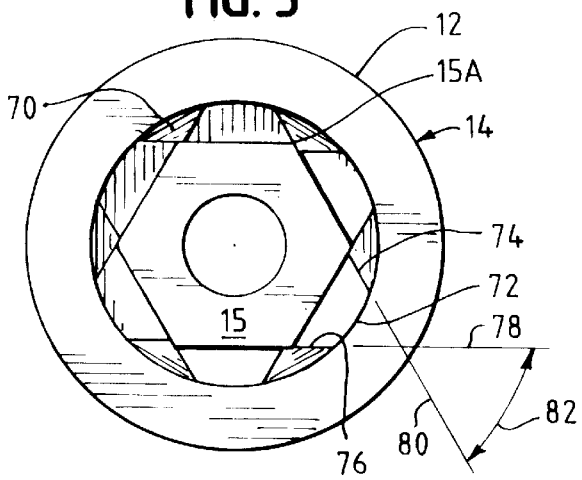
FIG. 5 is a bottom view of the wrench socket having an "easy on - easy off" configuration.

The wrench socket shown in FIG. 5 represents a new concept in the design of wrench sockets. In this embodiment, the nut engaging front end 14 also is the front end of hollow cylinder 12. It is shown engaging hexagonal nut 15. The remainder of the socket corresponds to the specific embodiments previously described. The configuration of the front end 14 may be adapted to be a conventional wrench socket which is shaped so that the back end 16 of hollow cylinder 12 is closed and contains drive hole 48, not shown.

Instead of conventional closely positioned points 70 with their corresponding closely positioned flats, there is substituted for these flats a large open arc designated by the numeral 72. This arc is terminated at its ends by opposed beveled points 74 and 76, respectively. The angles formed by these points, as shown by their projection lines 78 and 80, are opposed alternate interior angles. These angles in conjunction with open arc 72 form a rotational arc angles which is shown by inscribed arrowed arc line 82. As indicated, the arc may vary between 35 to 45 degrees; preferably, it is about 42 degrees.

In operation, when a jammed wheel lug nut occurs in the use of the wrench socket, the operator of the high impact torque wrench merely strikes the lug nut engaging front end 14 of the socket with a smart angular blow against any hard surface, such as the ground. This action forces the jammed wheel lug nut out of the socket due to the hollow cylinder 12 pushing against compression spring 58 which forces the jammed wheel lug nut into contact with the front end 42 of plunger 40.

In the case of the wrench socket illustrated in FIG. 5, it is possible to screw or unscrew a hexagonal nut without it being necessary to allow a powered wrench to which the socket is attached to come to a complete stop. Equally important is that the socket very easily engages and disengages nuts. The reason for these advantages is that the large open arc 72 allows almost instant alignment of the socket over a nut. The large open arc acts like a funnel and lines up the socket over hexagonal nut 15 so that once the points 15A of nut 15 clear the points 70 of the socket 10, hexagonal nut 15 slips on. Further enhancing the ease of the socket's ability to provide an "easy on - easy off" feature are the points arc cut at a large angle. This angle is usually one half of the angle of open arc 72. When hexagonal nut 15 comes into contact with these angled points, it engages them in a flat plain.

ADVANTAGES OF THE INVENTION

The invention allows for a wrench socket which has been specifically created for use in removing jammed wheel lug nuts from race cars.

The invention allows for the fast and easy removal of jammed wheel lug nut race cars, an operation in which time is of the essence.

The invention provides an improved form of a nut engaging opening for a wrench socket which is in the form of uniformly spaced apart triangles located within the interior of the front end of the socket. In the case of the wrench socket shown in FIG. 5, there is provided a socket which is "easy on-easy off." It can be attached to and withdrawn from hexagonal nuts even if it is moving, albeit at a slow speed. Also, this configuration greatly reduces the number of jams and may be used in the design of conventional wrench sockets.

The invention allows for the use of a wrench socket capable of withstanding repeated rapid use under high torques.

The invention allows for a wrench socket plunger combination that is combined in such a way as to act as a single unit and is substantially free from play between the two parts.

The invention provides an improved form of a lug nut engaging opening for a socket which is in the form of uniformly spaced apart triangles located within the interior of the front end of the socket.

I claim:

1. A wrench socket having a jammed lug nut freeing plunger for use with high torque impact wrenches to remove and replace wheel lug nuts from race cars comprising:

I) A hollow cylinder having an oversized lug nut engaging front end; a back end having a shoulder; an interior bore which contains longitudinal splines having slots extending at least one half its length; an outer wall; a horizontal removable pin located near the top of the hollow cylinder and extending through to its outer wall; and, II) A cylindrical rod shaped plunger substantially as long as the bore of the hollow cylinder having a front end, a back end fitted with a cap having a drive hole containing top, bottom, and sides, and is of larger dimension than the interior bore of the hollow cylinder; an exterior side wall having longitudinal splines whose projections mate in sliding relationship with the slots within the hollow cylinder, a vertical slot near the top of the plunger engaging the removable pin, which allows the plunger to extend into the lug nut engaging front end of the hollow cylinder from a retracted position, and III) A compression spring having a front end supported on the shoulder of the hollow cylinder and a back end which engages the bottom of the plunger's cap.

2. The wench socket of claim 1 where the front end of the cylindrical rod shaped plunger is recessed.

3. The wrench socket of claim 1 where the front end of the cylindrical rod shaped plunger is capable of extending at least part way into the lug nut engaging front end of the hollow cylinder.

4. The wrench socket of claim 1 where the front end of the cylindrical rod shaped plunger is capable of extending at least completely into the lug nut engaging front end of the hollow cylinder.

5. The wrench socket of claim 1 where the outer wall of the hollow cylinder is stepped in decreasing diameters from the front end to the back end.

6. The wrench socket of claim 1 where the torque of the impact wrench is about 500 lbs./sq. in.

7. The wrench socket of claim 1 where the lug nut engaging front end comprises a hexagonal shaped opening.

8. The wrench socket of claim 7 where the hexagonal shaped opening contains spaced apart beveled points having adjacent opposed interior angles which provide a rotational arc between 35 to 45 degrees.

9. The wrench socket of claim 1 where the hollow cylinder has extending substantially the length of its bore.

10. A wrench socket having a jammed lug nut freeing plunger for use with high torque impact wrenches to remove and replace wheel lug nuts from race cars comprising:

I) A hollow cylinder having an oversized lug nut engaging front end which contains positioned therein a plurality of lug nut engaging spaced apart triangles; a back end having a shoulder; an interior bore which contains longitudinal splines having slots extending at least one half its length; an outer wall; a horizontal removable pin located near the top of the hollow cylinder and extending through to its outer wall; and, II) A cylindrical rod shaped plunger substantially as long as the bore of the hollow cylinder having a front end, a back end fitted with a cap having a drive hole containing top, bottom, and sides, and is of larger dimension than the interior bore of the hollow cylinder; an exterior side wall having longitudinal splines whose projections mate in sliding relationship with the slots within the hollow cylinder; a vertical slot near the top of the plunger engaging the removable pin, which allows the plunger to extend into the lug nut engaging front end of the hollow cylinder from a retracted position, and III) A compression spring having a front end supported on the shoulder of the hollow cylinder and a back end which engages the bottom of the plunger's cap.

11. The wrench socket of claim 10 where the triangles are six in number.

12. The wrench socket of claim 11 where the triangles are equilateral.

* * * * *